US006619373B1

(12) United States Patent
Tooley et al.

(10) Patent No.: US 6,619,373 B1
(45) Date of Patent: Sep. 16, 2003

(54) LOST FOAM CASTING APPARATUS FOR REDUCING POROSITY AND INCLUSIONS IN METAL CASTINGS

(75) Inventors: Gordon Alwin Tooley, Saginaw, MI (US); Mark Eugene Hoover, Mount Morris, MI (US); June-Sang Siak, Troy, MI (US); Richard Simerson, Saginaw, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/132,878

(22) Filed: Apr. 25, 2002

(51) Int. Cl.[7] ..... B22C 9/08
(52) U.S. Cl. ..... 164/363; 164/349; 164/244
(58) Field of Search ..... 164/363, 349, 164/244, 133, 34

(56) References Cited

U.S. PATENT DOCUMENTS

| | | | | |
|---|---|---|---|---|
| 4,367,782 A | * | 1/1983 | Schrader | 164/137 |
| 4,693,292 A | | 9/1987 | Campbell | 164/34 |
| 4,802,527 A | * | 2/1989 | Brockmeyer et al. | 164/358 |
| 5,009,260 A | | 4/1991 | Cleary et al. | 164/255 |
| 5,069,271 A | * | 12/1991 | Chandley et al. | 164/516 |
| 5,263,533 A | | 11/1993 | Druschitz et al. | 164/363 |
| 6,189,598 B1 | * | 2/2001 | Chandley et al. | 164/34 |
| 6,435,257 B2 | * | 8/2002 | Simkovich | 164/122.1 |
| 6,453,976 B1 | * | 9/2002 | Chandley et al. | 164/34 |

OTHER PUBLICATIONS

Durham et al, "Observations on the Effect of Gating Design on Metal Flow and Defect Formation in Aluminum Lost Foam Castings: Part II", presented at the 105$^{th}$ Annual Meeting AFS Casting Congress, Apr. 28–May 1, 2001.

Tschopp, Jr. et al, "Mechanisms of Formation of Pyrolysis Defects in Aluminum Lost Foam Castings," *AFS Transactions*, #00–131, pp. 609–614 (No date available).

Tschopp, Jr. et al, "Processing Variable Significance on Metal Flow and Defect Formation in Thick–Section LFCs—Full Factorial Experiment," *AFS Transactions*, #00–132, pp. 267–274 (No date).

Vrieze et al, "Observations on the Effect of Gating Design on Metal Flow and Defect Formation in Aluminum Lost Foam Castings: Part I", presented at the 105$^{th}$ Annual Meeting AFS Casting Congress, Apr. 28–May 1, 2001.

* cited by examiner

*Primary Examiner*—Tom Dunn
*Assistant Examiner*—I.-H. Lin
(74) *Attorney, Agent, or Firm*—Kathryn A. Marra

(57) ABSTRACT

Apparatus for the gravity-cast, bottom-fill, "lost foam" casting of metal castings, including a fugitive, pyrolizable pattern (for forming a casting cavity), and a hollow sprue (for conducting melt to the casting cavity) embedded in a bed of loose sand. The sprue is free from pyrolyzable foam and conducts melt from above the pattern to a gating system supplying melt to the pattern. The sprue is constructed so as to cause the melt to approach the gating system from beneath and keep any pyrolysis products from entering the sprue.

10 Claims, 5 Drawing Sheets

LOST FOAM CASTING APPARATUS FOR REDUCING POROSITY AND INCLUSIONS IN METAL CASTINGS

TECHNICAL FIELD

This invention relates to apparatus for the gravity-cast, bottom-filled, "lost foam" casting of metal, and more particularly to sprues therefor that reduce porosity and inclusions in the casting.

BACKGROUND OF THE INVENTION

The so-called "lost foam" casting process is a well-known technique for producing metal castings wherein a fugitive, pyrolizable, polymeric, foam pattern is covered with a thin, gas-permeable, ceramic coating, and embedded in an unbounded sand mold to form a mold cavity within the sand. Molten metal (e.g., iron or aluminum) is then introduced into the mold cavity to pyrolize the foam pattern, and displace it with molten metal. Gaseous and liquid pyrolysis products escape through the gas-permeable, ceramic coating into the interstices between the unbonded sand particles. The most popular polymeric foam pattern comprises expanded polystyrene foam (EPS) having densities varying from 1.2 to 1.6 pounds per cubic foot. Other pyrolizable, polymeric foams such as polymethylmethacrylate (PMMA), and copolymers are also known. The molten metal may be either gravity cast (i.e., melt is poured from an overhead ladle or furnace) or countergravity cast (melt is forced, e.g., by vacuum or low pressure, upwardly into the mold from an underlying vessel).

In gravity cast lost foam processes, the hydraulic head of the melt is the driving force for filling the mold with melt. Gravity cast lost foam processes are known that (1) top-fill the mold cavity by pouring the melt into a basin overlying the pattern so that the melt enters the mold cavity through one or more gates located above the pattern, or (2) bottom-fill the mold cavity by pouring the melt into the flow channel of an elongated sprue that lies adjacent the pattern and extends from above the mold cavity to the bottom of the mold cavity for filling the mold cavity from the bottom through one or more gates located beneath the pattern. After cooling, the metal left in the sprue and the gate(s) are cut from the casting and recycled. FIGS. 1 through 5 (to be discussed hereinafter) depict various known sprue arrangements for bottom filling lost foam molds. Castings produced by these arrangements suffer from (1) undesirable porosity, (2) folds formed by trapped liquid pyrolysis products (hereafter liquid-induced folds) and/or (3) oxide inclusions in the finished casting resulting from the presence of pyrolizable foam in the sprue's flow channel. In this regard, when foam in the sprue's flow channel pyrolizes, gaseous pyrolysis products bubble back up through the melt in the flow channel where they cause considerable turbulence over and above that caused by pouring alone. This extra turbulence causes air, as well as gaseous and liquid pyrolysis products to become entrained in the melt, and carried forward into the mold cavity with the melt, where they cause liquid-induced folds, porosity and oxide inclusions which weaken the casting.

SUMMARY OF THE INVENTION

The present invention seeks to reduce the formation of pores, liquid-induced folds and oxide inclusions in bottom-filled, gravity cast, lost foam castings by eliminating pyrolizable foam from the flow channel of the sprue that supplies molten metal to the mold. More specifically, the present invention contemplates apparatus for the bottom-fill, gravity, lost-foam casting of a casting which apparatus comprises: a bed of loose sand forming a mold having a molding cavity therein for shaping molten metal into the casting; a flask containing the bed of sand; a fugitive pattern embedded in the sand and shaping the mold cavity, which pattern has the shape of the casting to be cast and comprises a polymeric foam pyrolizable by the molten metal; a fugitive body attached to the pattern and forming a gating system in the sand for supplying molten metal to the mold cavity, which body has an underside and is comprised of a pyrolizable foam; a downwardly-facing inlet to the gating system for admitting molten metal upwardly into the gating system into contact with the underside of the body; a hollow sprue embedded in the sand for conducting molten metal to the inlet, which sprue is free of pyrolizable foam and made from a material that is not pyrolizable by the molten metal; a mouth at one end of the sprue higher than the pattern for admitting molten metal into the sprue; and an upwardly-facing outlet at the other end of the sprue underlying the gating system and engaging the inlet for directing molten metal from the sprue upwardly into the gating system. Preferably, the sprue is made from a porous, gas-permeable ceramic. Most preferably, the porous ceramic sprue is made from ceramic fibers or particles (e.g., alumina, alumina silicate, silicon carbide, fiberglass, bonded sand, bonded glass spheres, bonded hollow ceramic spheres, and ceramic aggregates).

According to one embodiment, the sprue is L-shaped having a central flow channel through which the melt flows, a vertical leg that receives gravity-poured molten aluminum from an overhead ladle or furnace, and a horizontal leg extending from the vertical leg to beneath the gating system. The mouth that receives the poured melt is atop the vertical leg and the outlet that engages the inlet to the gate is atop the horizontal leg.

Most preferably, the sprue has a J-shaped flow channel having: a first leg that receives molten metal gravity-poured into the sprue and flows it downwardly adjacent the pattern; a second leg, shorter than the first leg, for flowing the molten metal upwardly toward the inlet to the gating system; and a transition section joining the first and second legs for changing the direction of flow of the molten metal between the first leg and the second leg. Preferably, the cross-sectional area of the flow channel transverse the second leg is greater than the cross-sectional area of the transition section between the legs to slow down the rate of advance of the melt front toward the gating system.

The present invention prevents any pyrolysis products from becoming entrained in the melt in the sprue, and insures that any pyrolysis products that are formed are pushed into the gating system and/or molding cavity ahead of the advancing melt front.

BRIEF DESCRIPTION OF THE DRAWINGS

The invention will be better understood when considered in the light of the following detailed description of certain specific embodiments thereof which is provide hereafter in conjunction with the several figures in which.

DESCRIPTION OF THE INVENTION

Figure 1:
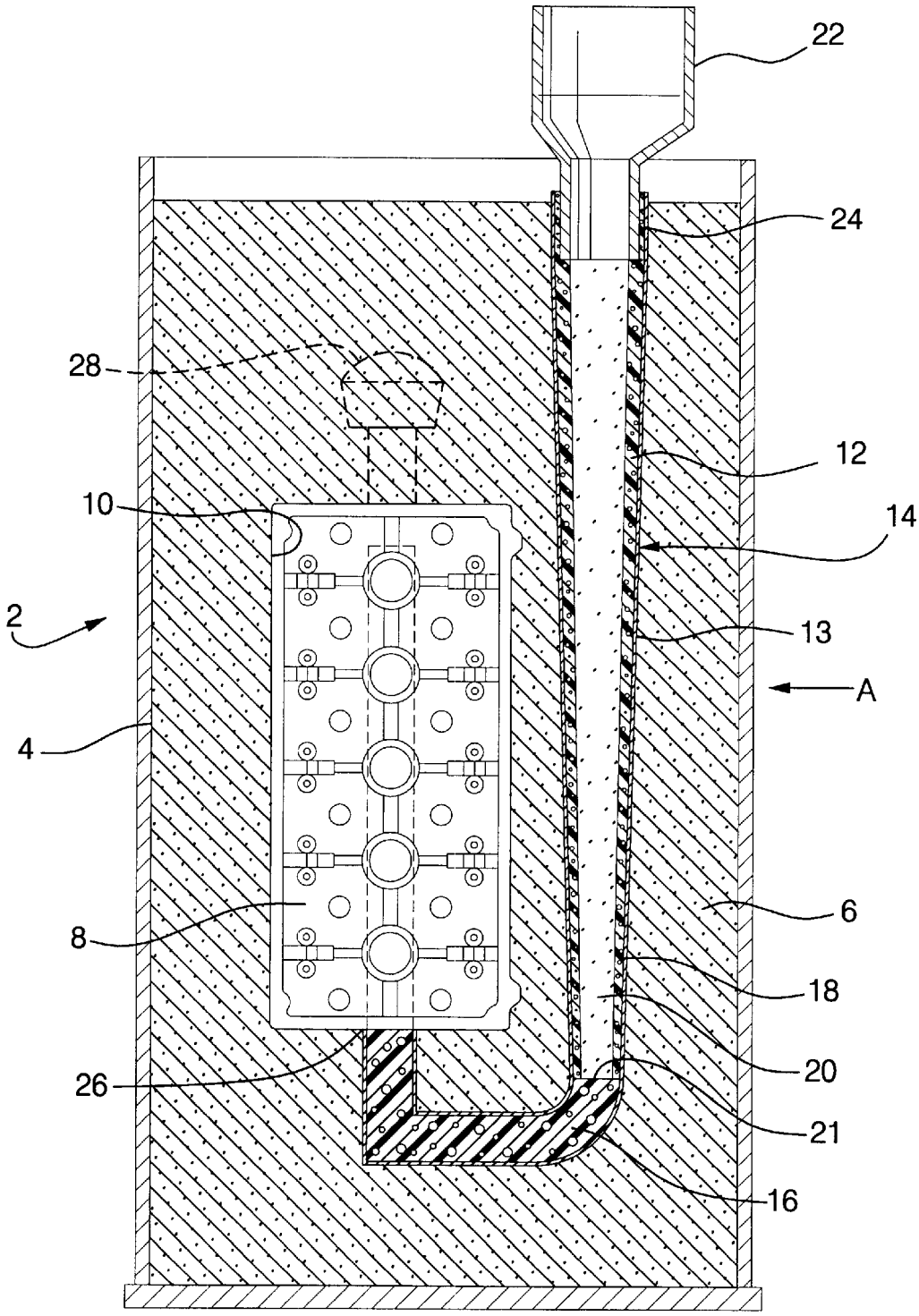
PRIOR ART FIG. 1
FIG. 1 is a side sectional view of a sand-filled, lost foam casting flask having a pattern, and prior art sprue therefor, embedded therein.

FIG. 1 depicts a known, lost foam mold 2 comprising a metal flask 4 filled with loose sand 6 packed around a fugitive, EPS foam pattern 8 that forms a mold cavity 10 in the sand 6. The pattern 8 is coated with a thin, gas-permeable, ceramic layer as is well known in the art. The mold cavity 10 receives and shapes molten metal supplied thereto into an article of manufacture (hereafter "casting"), here shown to be a head for an internal combustion engine. While a single head could be cast in a single pouring of melt, in actual commercial practice, two heads are formed at the same time in a single pouring. In this regard, it is common practice to attach two discrete patterns 8 to a gating system (not shown), which is common to both patterns 8, and which serves to distribute melt to both the mold cavities 10 during pouring. Such a common gating system will be discussed in more detail in conjunction with FIG. 7. A riser 28 atop the gating system receives additional melt and supplies it back to the gating system to make up for shrinkage during cooling/solidification. If only one article is cast per pour, a simpler gating system may be employed, e.g., one or more gate(s) admitting melt directly into the bottom of the mold cavity 10.

Molten metal is supplied to the gating system from a sprue 12 which is made from the same pyrolizable foam as the pattern 8, and is coated with a thin gas-permeable ceramic layer 13. The sprue 12 has: (1) a mouth 24 at one end, (2) a hollow portion 14 extending from the mouth 24 to a level below the pattern 8, and (3) a solid foam portion 16 extending from the lower end 21 of the hollow portion 14 to the inlet 26 to the gating system. The hollow portion 14 comprises a foam wall 18 defining an internal flow channel 20. A metal fill cup 22 positioned in the mouth 24 of the sprue 12 receives melt from an overhead ladle or furnace (not shown), and directs it into the flow channel 20. Alternatively, it is known to use a similar sprue arrangement, but wherein the hollow portion 14 is replaced with solid foam. In either case, the heat from the molten metal pyrolizes the foam that makes up both the hollow and solid portions of the sprue 12. The pyrolysis gases bubble-up through the melt in the sprue causing turbulence in the melt. The turbulence results in air, and some of the pyrolysis liquid and gaseous pyrolysis products, becoming entrained in, and/or reacting with, the melt, which causes liquid-induced folds, pores, and nonmetallic inclusions, to form in, and weaken, the casting.

Figure 2:
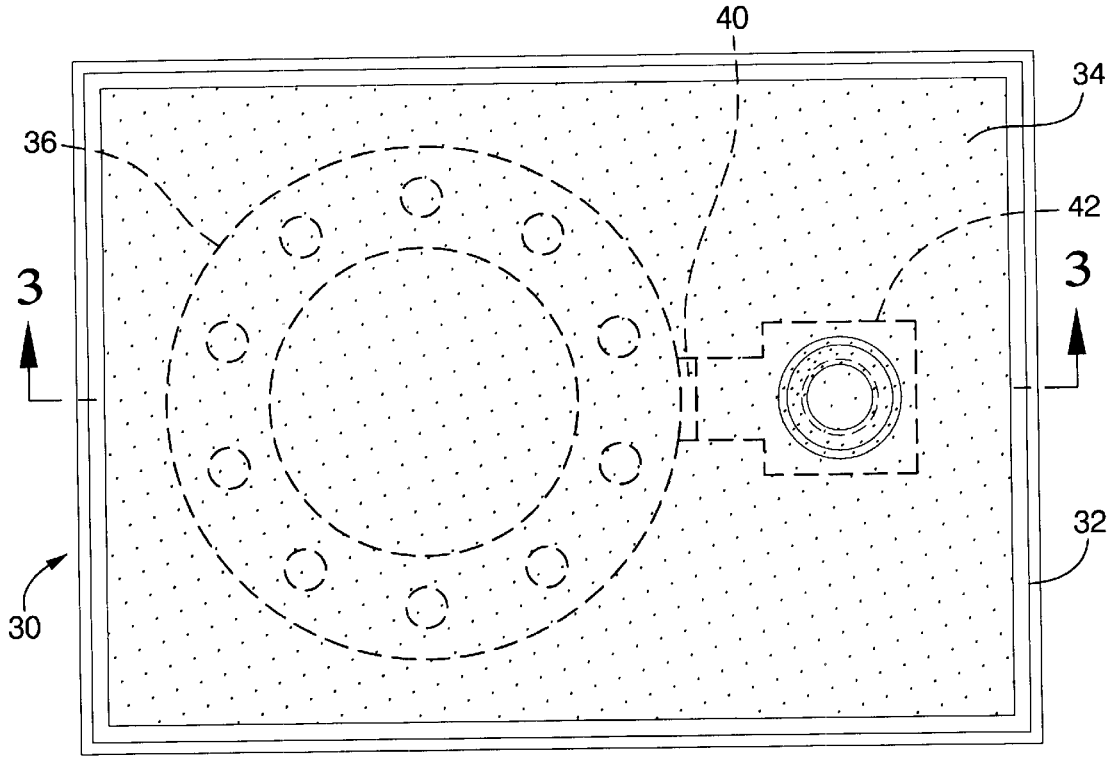
PRIOR ART FIG. 2
FIG. 2 is a plan view of a sand-filled, lost foam casting flask having another prior art pattern, and sprue arrangement embedded therein.
Figure 3:
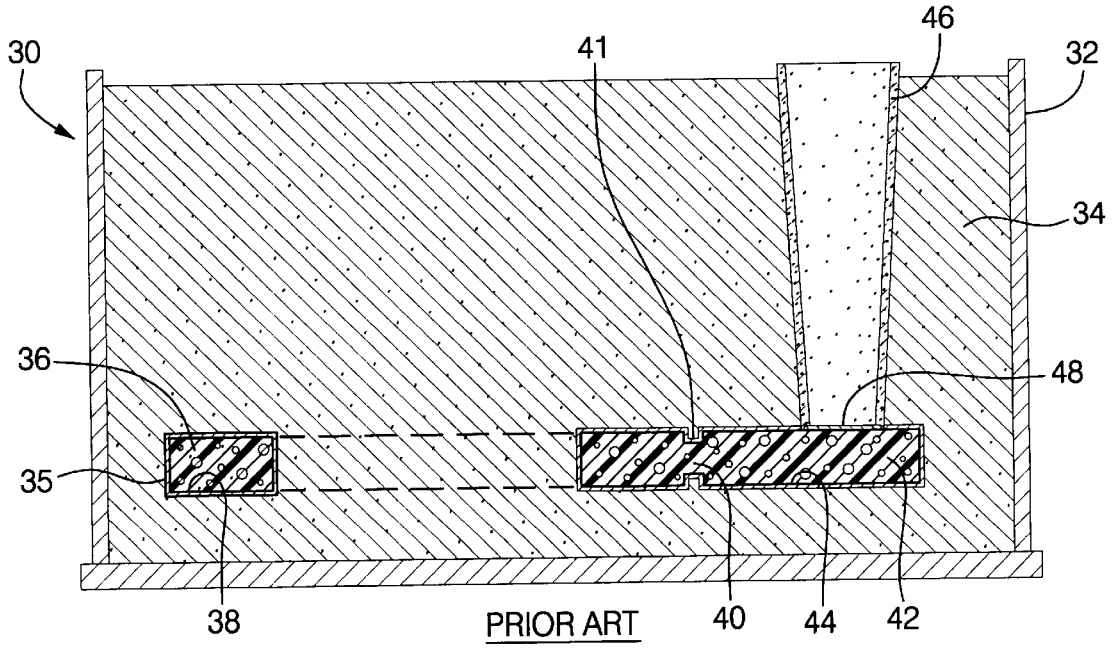
PRIOR ART FIG. 3
FIG. 3 is a sectional view in the direction 3—3 of FIG. 2.

FIGS. 2 and 3 depict another known lost foam mold and sprue arrangement. A lost foam mold 30 comprises a metal flask 32 filled with loose sand 34 packed around a fugitive, EPS foam pattern 36 that forms a mold cavity 38 in the sand 34. The pattern 36 is coated with a thin ceramic layer 35 as is well known in the art. The pattern 36 is filled from the side, and includes a narrow section of foam 40 that forms a gate 41 in the sand for supplying melt to the mold cavity 38. The gate-forming, narrow section 40 is attached to an EPS foam pad 42 that forms a chamber 44 in the sand 34 that receives the melt before it is supplied to the mold cavity 38. A hollow sprue 46 sits atop the pad 42 and comprises a porous, gas-permeable, ceramic fiber shell commercially available to the lost foam foundry industry under the trade name PYROTEK CF 300™. A thin (e.g., 1/16 inch), fusible, aluminum (e.g., 356A) wafer 48 separates the bottom end of the sprue 46 from the foam pad 42. The aluminum wafer 48 reduces the turbulence in the melt poured into the sprue by allowing some of the melt to accumulate in the sprue before the wafer 48 melts. When the aluminum wafer 48 melts, the melt flows into the chamber 44 and thence into the mold cavity 38. The molten metal pyrolyzes the foam in the pad 42 and the pyrolisis gases bubble-up through the column of melt in the sprue 46 causing turbulence therein which results in air, liquid pyrolysis products and some of the pyrolysis gases becoming entrained in, and reacting with, the melt. Pores, folds and nonmetallic inclusions are thereby formed in and weaken the casting. It is also known to substitute a porous ceramic filter for the aluminum wafer 48 with similar results.

Figure 5:
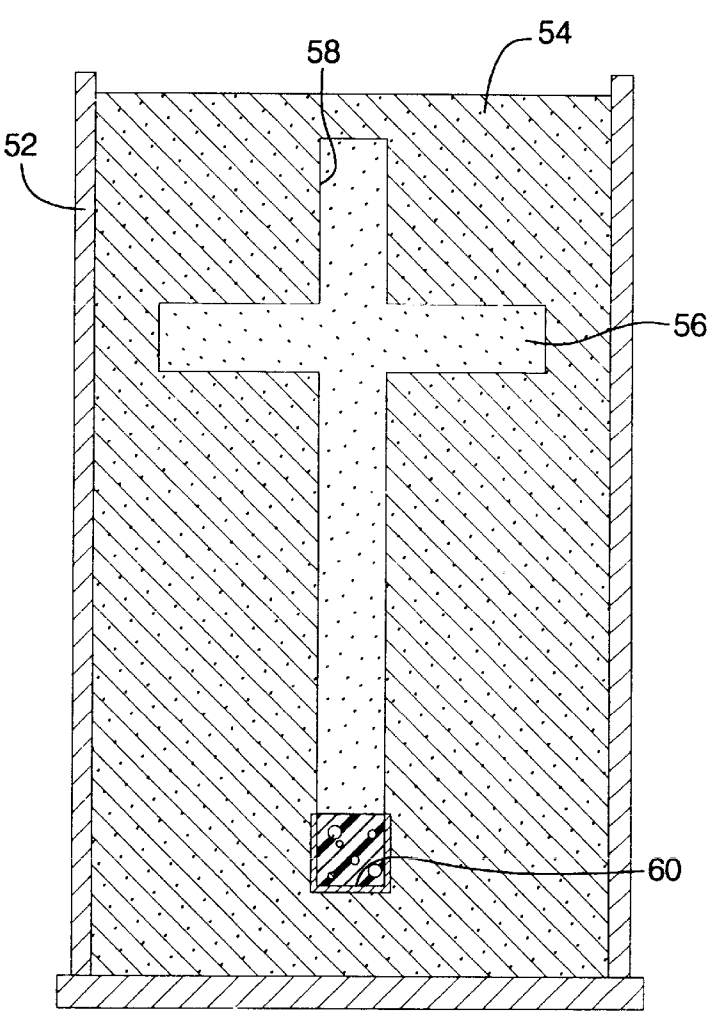
PRIOR ART FIG. 5
FIG. 5 is view in the direction 5—5 of FIG. 4.
Figure 4:
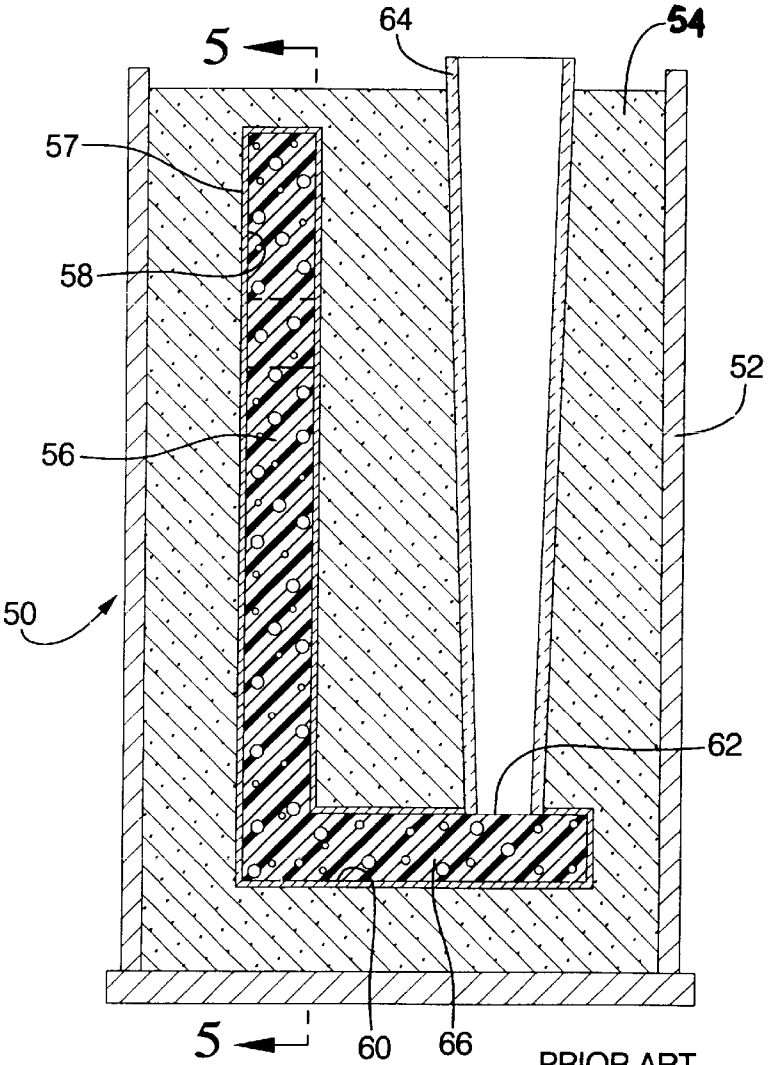
PRIOR ART FIG. 4
FIG. 4 is a side sectional view of a sand-filled, lost foam casting flask having still another prior art pattern and sprue arrangement embedded therein.

FIGS. 4 and 5 depict still another known lost foam mold and sprue arrangement. A lost foam mold 50 comprises a metal flask 52 filled with loose sand 54 packed around a fugitive, EPS foam pattern 56 that forms a mold cavity 58 in the sand 54. The pattern 56 is coated with a thin gas-permeable ceramic layer 57. The pattern 56 is filled from the bottom by means of a horizontal runner 60 that connects the bottom of the mold cavity 58 with the outlet 62 of a hollow sprue 64. The runner 60 is formed in the sand 54 by a slab 66 of pyrolizeable EPS foam. The hollow sprue 64 sits atop the slab 66, and comprises a porous, gas-permeable, non-pyrolizable, commercially available shell made from ceramic fibers (PYROTEK supra). The molten metal poured into the sprue 64 pyrolyses the foam in the slab 66, and the pyrolysis gases therefrom bubble-up through the melt in the sprue 64 causing turbulence therein which results in air, liquid pyrolysis products, and some of the pyrolysis gases becoming entrained in, and reacting with, the melt. Pores, folds and nonmetallic inclusions are thereby formed in, and weaken, the casting.

Figure 6:
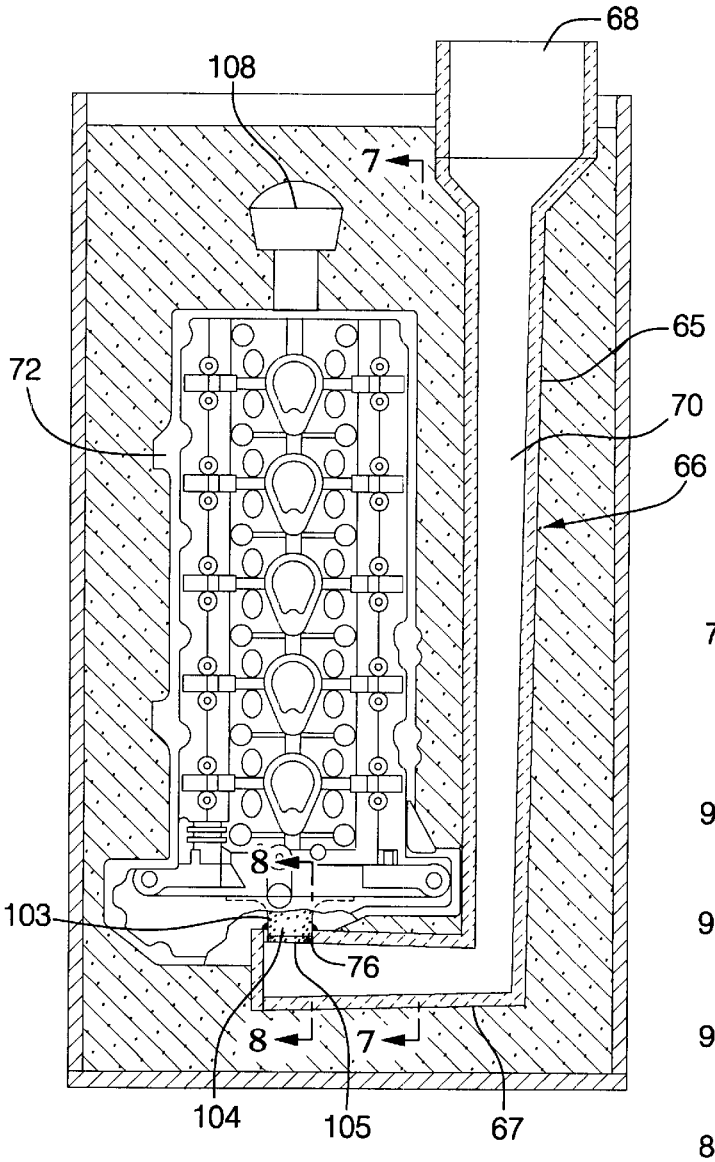
FIG. 6 is partially broken-away, partially sectioned view of a lost foam casting flask having a pattern and sprue arrangement according to one embodiment of the present invention, suspended therein.
Figure 7:
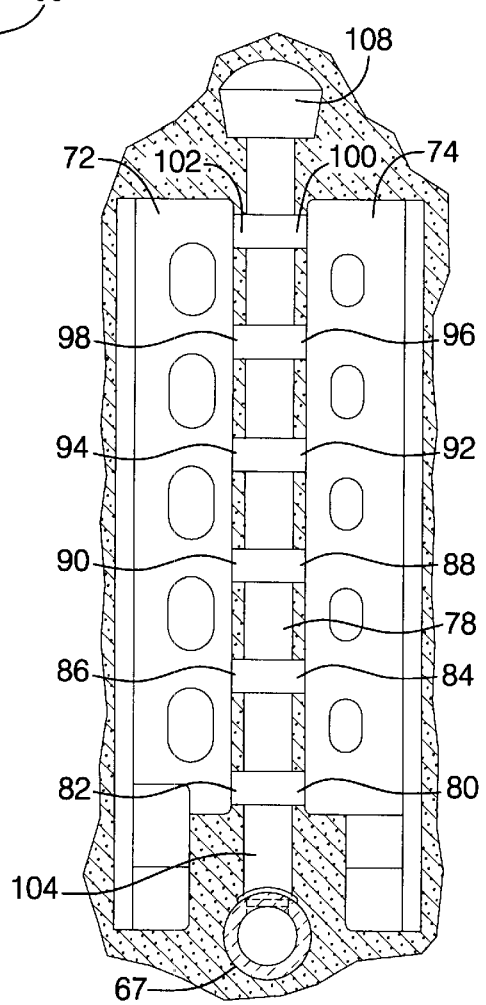
FIG. 7 is a view taken in the direction 7—7 of FIG. 6.
Figure 8:
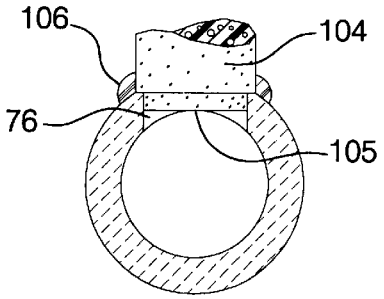
FIG. 8 is view (sans sand/flask) taken in the direction 8—8 of FIG. 6.

FIGS. 6–8 depict one embodiment of the present invention and has a hollow, foam-free, L-shaped sprue 66 made from a material that is not pyrolizable by the molten metal. The sprue 66 has a vertical leg 65, a horizontal leg 67, a mouth 68 at the upper end of the vertical leg 65 for receiving molten metal from an overhead ladle or furnace (not shown), and an internal flow channel 70 for directing melt to an upwardly facing outlet 76 in the horizontal leg 67 at the other/exit end of the sprue 66. As best shown in FIG. 7, horizontal leg 67 of the sprue 66 supplies melt to a fugitive body of foam 78 that is attached to two discrete patterns 72, 74 for forming corresponding mold cavities in the sand. The foam body 78 forms a gating system in the sand that simultaneously dispenses melt to the mold cavities formed by the patterns via a plurality of gates 80–102 so that two castings are formed in a single pouring. Molten metal is introduced into the bottom of the gating system through a downwardly facing inlet 103 formed in the sand by the foam projection 104 on the underside of the body 78. The end 105 projection 104 is necked-down and nests within the upwardly facing outlet 76 at the exit end of the sprue 66. A bead of glue 106 secures the projection to the outlet 76. Molten metal poured into the mouth 68 of the sprue 66 travels down through the flow channel 70, and then upwardly out of the outlet 76 where it contacts end 105 of the projection 104. The heat from the melt pyrolizes the projection 104 leaving the inlet 103 open for melt to pass through into the gating system formed by the fugitive foam body 78. The melt displaces the foam body 78 and progressively rises in the gating system and spills over into each of the mold cavities formed by the patterns 72, 74 via the several gates 80–102. As there is no pyrolizable foam anywhere in the flow channel, no pyrolysis gases can form therein and bubble back up through the channel causing excessive turbulence. Rather, pyrolysis begins when the heat from melt begins to dissociate the projection 104. However, the pyrolysis liquids and gases resulting from dissociation of the projection 104, and the body 78, all move ahead of the melt front that advances upwardly into the gating system formed by the foam body 78. These gases pass through the permeable ceramic coating that was left by the patterns 72, 74 and now holds the sand in place, and into the sand forming the mold cavities. Hence, the pyrolysis gases that form from the foam body 78 do not bubble back into the flow channel 70. A foam crown 108 atop the body 78 forms a riser in the sand for receiving melt near the end of the pour and feeding it back into the gating system as the melt shrinks during cooling and solidification.

Figure 9:
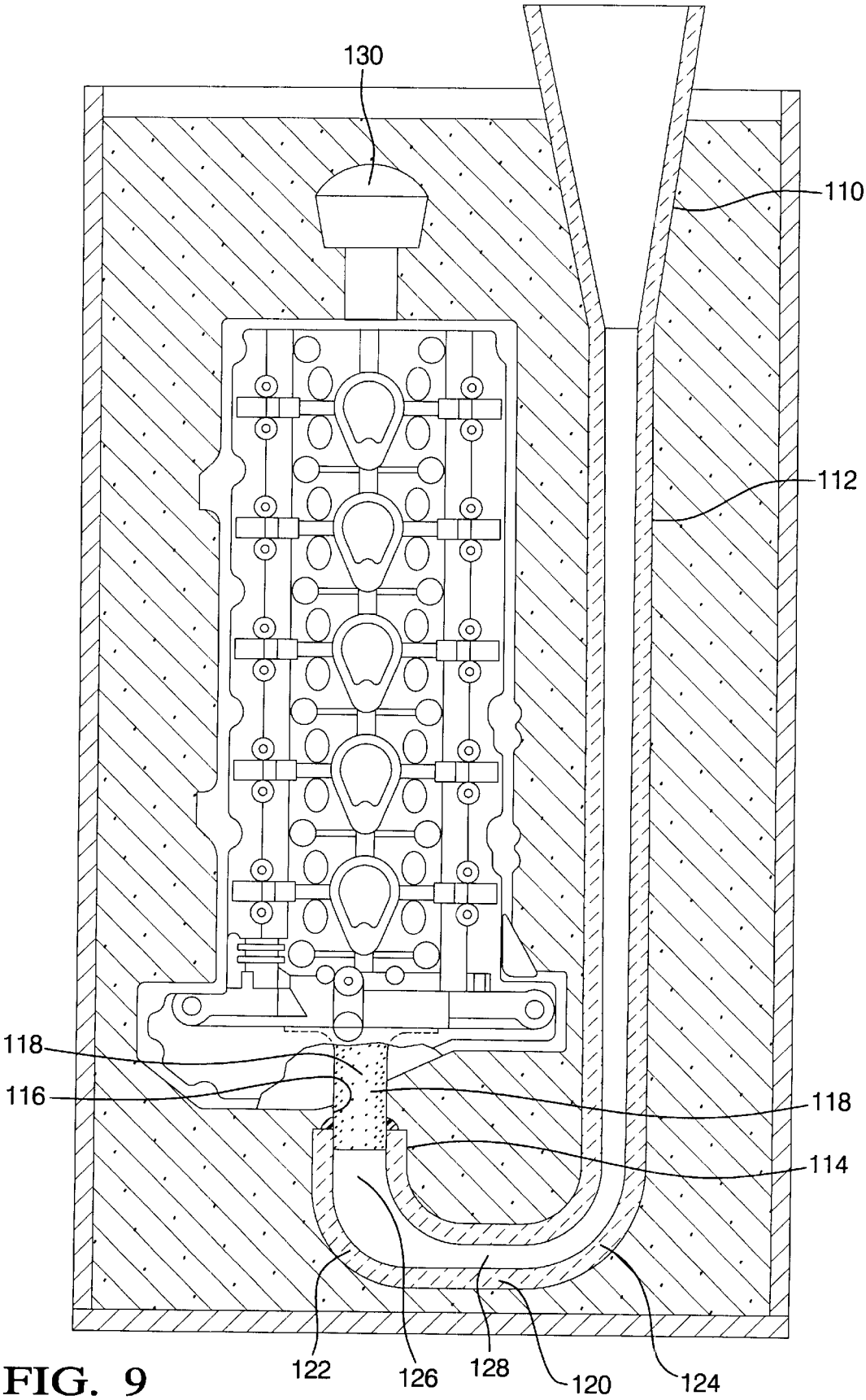
FIG. 9 is a partially broken-away, partially sectioned view of a lost foam casting flask having a pattern and sprue arrangement according to a preferred embodiment of the present invention.

FIG. 9 depicts a preferred embodiment of the invention wherein the sprue 110 is generally J-shaped having a first vertical leg 112 for receiving molten metal from an overhead ladle or furnace, and a second vertical leg 114, shorter than the first leg 112, for directing the flow of molten metal upwardly into the inlet 116 to the gating system formed by the projection 118 at the bottom of a foam body (not shown) that forms the gating system. The second, shorter vertical leg 14 insures that the melt approaches the EPS projection 118 from beneath such that the pyrolysis gases that form are trapped in the leg 114 between the rising melt front and the foam that has not yet pyrolyzed. These gases can only escape through the walls of the sprue or upwardly into the gating system and thence into the surrounding sand. The first and second vertical legs are joined by a transition member or connector section 120 that is preferably curved at both ends 122 and 124 to provide a smooth, non-turbulent flow transition around the bends between the vertical legs 112, 114 and the connector section 120. Most preferably, the cross-sectional area of the flow channel 126 in the second vertical leg 114 will be greater than the cross sectional area of the flow channel 128 in the transition/connector section 120 so as to slow the rate at which the melt front advances upwardly in the second vertical leg and the gating system. A foam crown 130 forms a riser in the sand for feeding melt into the gating system as the casting cools/solidifies.

The non-pyrolizable material that forms the sprue will preferably comprise a thermally insulating ceramic that, most preferably, is also gas-permeable. The sprue may be made from sintered ceramic particles (e.g., silicon carbide, alumina silicate, alumina, $SiO_2$, etc. supra), or most preferably, from slip-cast or slurry-cast ceramic fibers that are bonded together and have a porosity of about 30% to about 80%. The sprues may also be injection molded. Gas permeability is desirable as it provides an escape route through the sprue's walls for gases that might otherwise be trapped in the melt as it flows through the sprue into the mold cavity. Thermally insulating the melt from the sand permits casting articles using lower temperature melts, which results in considerable energy savings and slower pyrolysis rates for less gas entrainment. For example, it has been found that by using porous, foam-free sprues made from ceramic fibers, the pouring temperature of an A356 aluminum alloy can be reduced from 1440° F. to 1325° F. with no loss in properties.

Castings made according to the most preferred embodiment of the invention (i.e., the J-shaped sprue) have consistently demonstrated porosities of 0.04% or less 0.04% and pore sizes of 163 $\mu$m (max), in contrast to porosities of 0.15% and pore sizes of 296 $\mu$m (max) for castings poured using a sprue arrangement like that shown in FIG. 1, but with the hollow foam portion 14 of sprue 12 replaced with a hollow ceramic fiber sprue.

While the invention has been described in terms of certain specific embodiments thereof it is not intended to be limited thereto, but rather only to the extent set forth hereafter in the claims which follow.

What is claimed is:

1. Apparatus for the gravity, lost-foam, casting of a metal casting comprising: (1) a bed of loose sand forming a mold having a molding cavity therein for shaping molten metal into said casting; (2) a flask containing said bed; (3) a fugitive pattern embedded in said sand and shaping said cavity, said pattern having the shape of said casting and comprising a polymeric foam pyrolizable by the molten metal; (4) a fugitive body attached to said pattern and forming a gating system in said sand for supplying molten metal to said cavity, said body having an underside and comprising said pyrolizable foam; (5) a downwardly-facing inlet to said gating system for admitting molten metal upwardly into said gating system into contact with said underside of said body; (6) a hollow sprue embedded in said sand for conducting molten metal to said inlet, said sprue being free of said foam and made from a material which is non-pyrolizable by molten metal; (7) a mouth at one end of said sprue higher than said pattern for admitting molten metal into said sprue; and (8) an upwardly-facing outlet at the other end of said sprue underlying said gating system and engaging said inlet for directing molten metal from said sprue upwardly into said gating system.

2. Apparatus according to claim 1 wherein said material comprises a ceramic.

3. Apparatus according to claim 2 wherein said ceramic is porous.

4. Apparatus according to claim 2 wherein said ceramic comprises ceramic fibers.

5. Apparatus according to claim 4 wherein said fibers are selected from the group consisting of alumina, alumina silicate, silicon carbide, fiberglass, bonded sand, bonded glass spheres, bonded hollow ceramic spheres, and light weight ceramic aggregates.

6. Apparatus according to claim 1 wherein said sprue is L-shaped having a vertical leg receiving molten metal gravity poured into said sprue, and a horizontal leg beneath said gating system, said mouth being atop said vertical leg and said outlet being atop said horizontal leg.

7. Apparatus according to claim 1 wherein said sprue has a J-shaped flow channel having (i) a first leg for receiving molten metal gravity-poured into said sprue and flowing it downwardly adjacent said pattern, (ii) a second leg shorter than said first leg for flowing said molten metal from said first leg upwardly toward said inlet, and (iii) a transition section joining said legs for reversing the direction of flow of said molten metal between said legs.

8. Apparatus according to claim 7 wherein said transition section has a first end coupled to said first leg at a first turn, and a second end coupled to said second leg at a second turn, wherein at least one of said turns is curved.

9. Apparatus according to claim 7 wherein the cross-sectional area of said flow channel transverse said second vertical leg is greater than the cross sectional area of said section transverse said transition section.

10. Apparatus for the gravity, lost-foam, casting of a casting comprising: (1) a bed of loose sand forming a mold having a molding cavity therein for shaping molten metal into said casting; (2) a flask containing said bed; (3) a fugitive pattern embedded in said sand and shaping said cavity, said pattern having the shape of said article and comprising a polymeric foam pyrolizable by molten metal; (4) a fugitive body attached to said pattern and forming a gating system in said sand for supplying molten metal to said cavity, said body having an underside and comprising said pyrolizable foam; (5) a downwardly-facing inlet to said gating system for admitting molten metal upwardly into said gating system into contact with said underside of said body; (6) a hollow, gas permeable sprue embedded in said sand for conducting molten metal to said inlet, said sprue being free of said foam and comprising ceramic fibers selected from the group consisting of alumina, alumina silicate, silicon carbide, fiberglass, bonded sand, bonded glass spheres, bonded hollow ceramic spheres, and ceramic aggregates; (7) a mouth at one end of said sprue higher than said pattern for admitting molten metal into said sprue; and (8) an upwardly-facing outlet at the other end of said sprue underlying said gating system and engaging said inlet for directing molten metal from said sprue upwardly into said gating system.

* * * * *